US007510297B2

(12) United States Patent
Dobija et al.

(10) Patent No.: US 7,510,297 B2
(45) Date of Patent: Mar. 31, 2009

(54) LUMINOUS WALL SYSTEM

(76) Inventors: Michael J. Dobija, 875 Acapulco St., Laguna Beach, CA (US) 92651; Hans Deitrich, Folio, Inc., Coppell, TX (US) 75019

( * ) Notice: Subject to any disclaimer, the term of this patent is extended or adjusted under 35 U.S.C. 154(b) by 0 days.

(21) Appl. No.: 11/698,924

(22) Filed: Jan. 29, 2007

(65) Prior Publication Data

US 2008/0180943 A1 Jul. 31, 2008

(51) Int. Cl.
*G09F 13/04* (2006.01)

(52) U.S. Cl. ..... 362/147

(58) Field of Classification Search ..... 362/812; 40/576, 618

See application file for complete search history.

(56) References Cited

U.S. PATENT DOCUMENTS

| | | | | |
|---|---|---|---|---|
| 1,546,089 | A | 7/1925 | Leachman et al. | |
| 1,607,922 | A | 11/1926 | Schweitzer | |
| 1,725,230 | A | 8/1929 | Ulrich | |
| 2,654,827 | A | 10/1953 | Pierce | |
| 3,760,179 | A | 9/1973 | Addington, Jr. | |
| 3,783,544 | A | 1/1974 | Brody | |
| 4,469,726 | A | 9/1984 | Niinivuo | |
| 4,835,916 | A | 6/1989 | Steadman | |
| 4,932,170 | A | 6/1990 | Spear | |
| D312,664 | S | 12/1990 | Kaut | |
| 5,106,660 | A | 4/1992 | Vorel | |
| 5,251,392 | A | 10/1993 | McManigal | |
| 5,347,736 | A * | 9/1994 | Kanigan | 40/576 |
| 5,381,324 | A * | 1/1995 | Hillstrom et al. | 362/362 |
| 5,426,879 | A | 6/1995 | Hecker | |
| 7,412,751 | B2 * | 8/2008 | Forrest | 16/82 |
| 2005/0060949 | A1 | 3/2005 | McNaught | |

FOREIGN PATENT DOCUMENTS

| | | |
|---|---|---|
| DE | 198 58 565 | 6/2000 |
| JP | 9-302840 | 11/1997 |

OTHER PUBLICATIONS http://www.cpidaylighting.com/litewall.html "Litewall Systems" retrieved on Jul. 27, 2006.

* cited by examiner

*Primary Examiner*—Anabel M Ton
(74) *Attorney, Agent, or Firm*—Richard C. LItman

(57) ABSTRACT

The luminous wall system has translucent panels, frame hardware, light fixtures and a reflective plenum. The system includes individual, preferably translucent panels, which are aligned by interconnecting frame extrusions. Stand-off compression brackets are mounted on the supporting subwall and provide for mounting vertical extrusions, as well as for creating sufficient space between the subwall and the system to allow for lighting components, which are mounted on the subwall. Horizontally extending extrusions are aligned and interlocked by an alignment bracket that fits over and fastens to the horizontal extrusions and an intervening vertical extrusion. The panels can be attached to the extrusions via threaded fasteners applied to threaded channels in the extrusions. Alternatively, the panels can fit into unthreaded extrusion channels and be held in place by attachment of a series of overlaying battens.

18 Claims, 18 Drawing Sheets

LUMINOUS WALL SYSTEM

BACKGROUND OF THE INVENTION

1. Field of the Invention

The present invention relates to wall systems, and more specifically to a luminous wall system that provides a back-illuminated wall system utilizing extrusions as support members for a succession of panels, such as translucent wall sections.

2. Description of the Related Art

Light diffusing structural panels, as of the type disclosed in Japanese Patent No. 93,02,840, published Nov. 25, 1997, are described within a system that provides support of the panel by inner and outer frames.

Although the aforementioned Japanese patent describes a system that can be employed in a store or showroom, the patent does not appear to disclose the specific configurations contemplated by the present invention.

It would be desirable to describe a luminous wall system that could be used in a variety of environmental configurations, not just storefronts and the like, as described in the aforementioned Japanese patent.

None of the above inventions and patents, taken either singly or in combination, is seen to describe the instant invention as claimed. Thus, a luminous wall system solving the aforementioned problems is desired.

SUMMARY OF THE INVENTION

The luminous wall system comprises translucent panels, frame hardware, light fixtures and a reflective plenum. The system includes individual, preferably translucent panels, which are aligned by interconnecting frame extrusions. Stand-off compression brackets are mounted on the supporting subwall and provide a means for mounting vertical extrusions, as well as a means for creating sufficient space between the subwall and the system in order to allow for lighting components, which are mounted on the subwall.

Horizontally extending extrusions are aligned and interlocked by an alignment bracket that fits over and fastens to the horizontal extrusions and an intervening vertical extrusion. The panels can be attached to the extrusions via threaded fasteners applied to serrated channels in the extrusions. Alternatively, the panels can fit into unthreaded extrusion channels and be held in place by attachment of a series of overlying battens. A variety of corner configurations are disclosed for providing a finished corner edge appearance.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
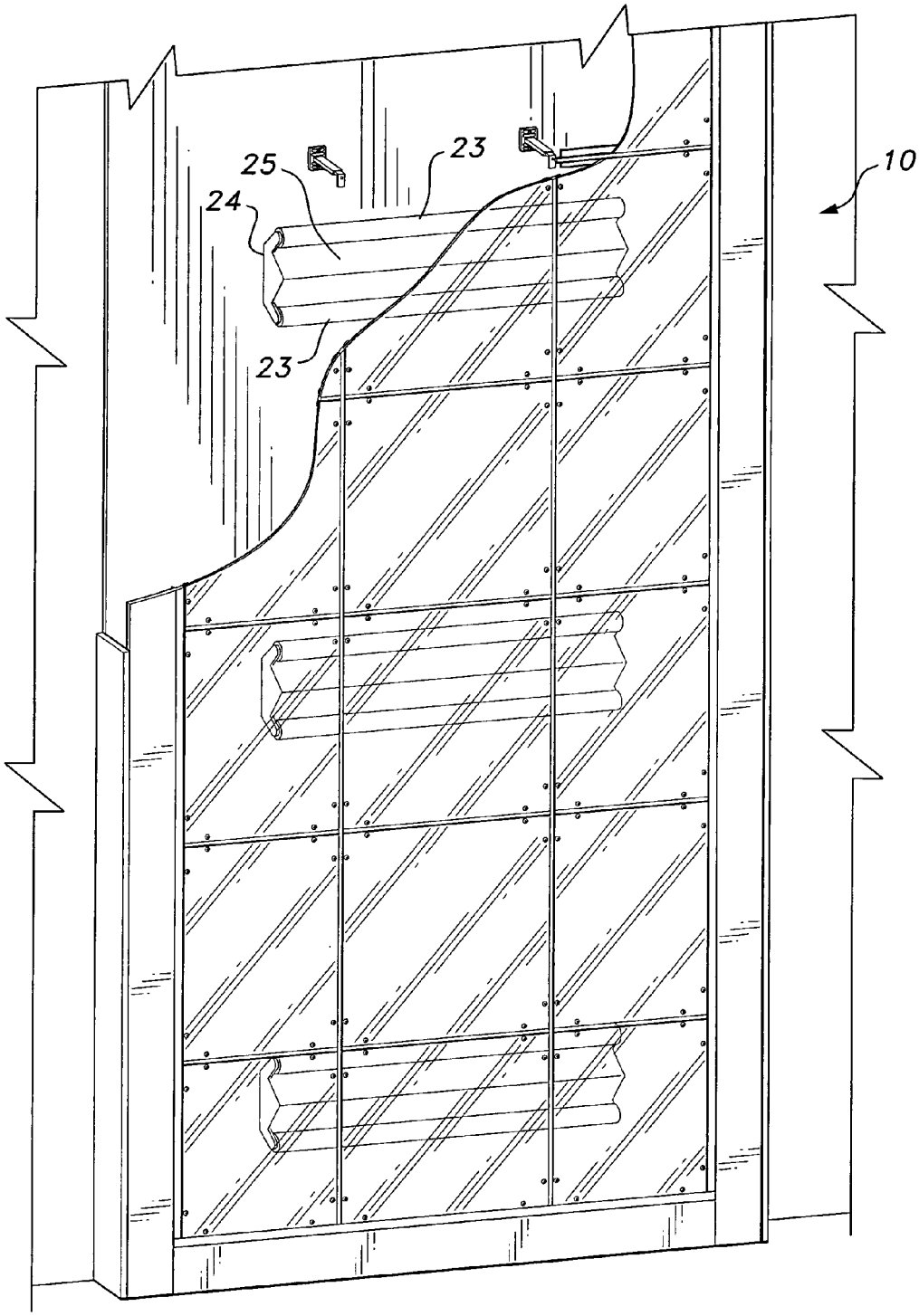
FIG. 1 is an environmental, perspective view of a luminous wall system according to the present invention.
Figure 2:
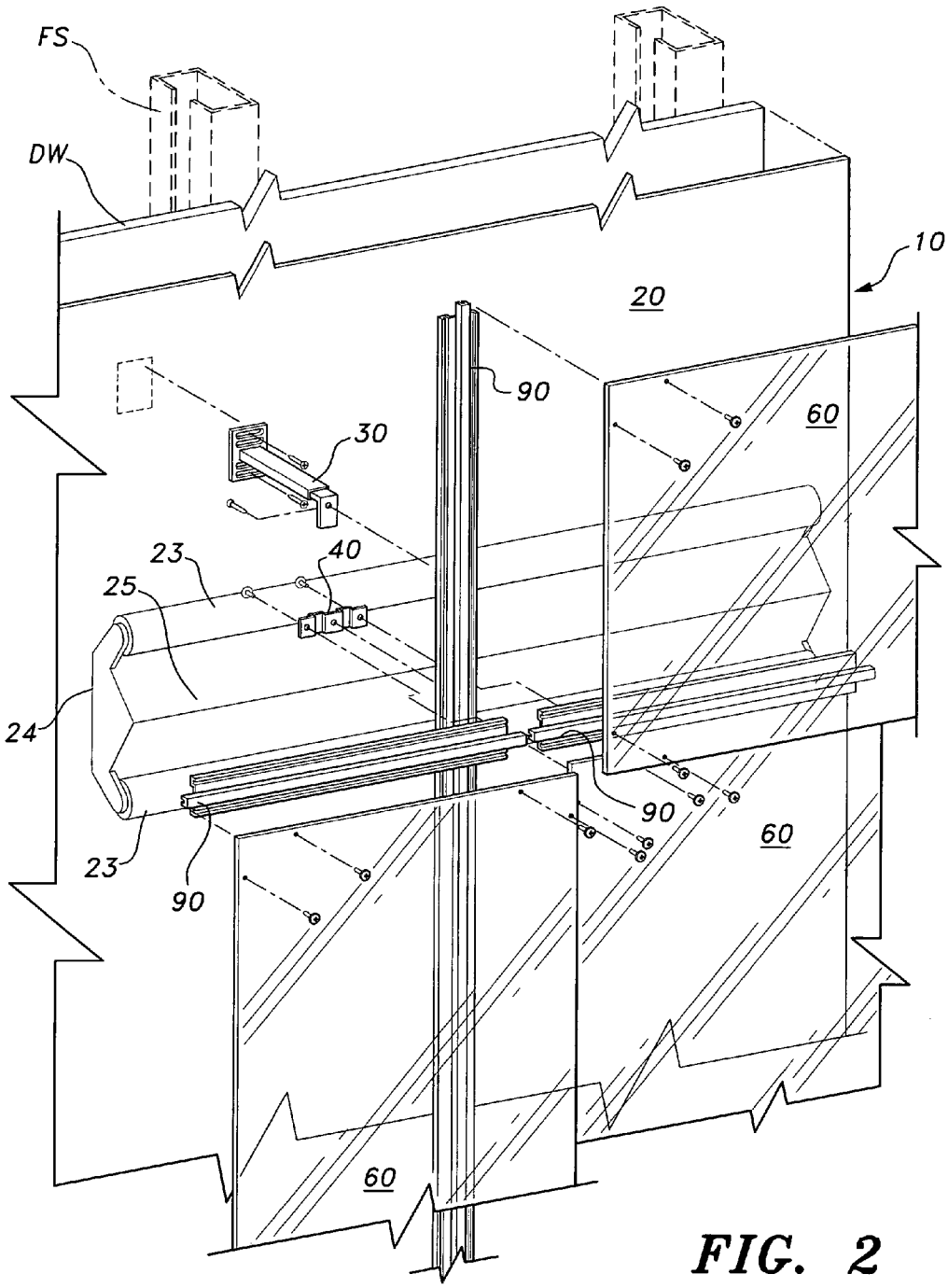
FIG. 2 is a partially exploded, perspective view of the luminous wall system according to the present invention.

As shown in FIGS. 1 and 2, the present invention comprises a luminous wall system 10 having translucent panels, frame hardware, light fixtures and a reflective plenum. The system includes individual, preferably translucent panels, which are aligned by interconnecting frame extrusions. Stand-off compression brackets are mounted on the supporting subwall and provide a means for mounting vertical extrusions, as well as a means for creating sufficient space between the subwall and the system to allow for lighting components, which are mounted on the subwall.

Horizontally extending extrusions are aligned and interlocked by an alignment bracket that fits over and fastens to the horizontal extrusions and an intervening vertical extrusion. The panels can be attached to the extrusions via threaded fasteners applied to serrated channels in the extrusions. Alternatively, the panels can fit into unthreaded extrusion channels and held in place by attachment of a series of overlaying battens. A variety of corner configurations are disclosed for providing a finished corner edge appearance.

The system has a plurality of frame components capable of supporting aesthetic panels in a variety of wall environments. The frame components comprise at least one compression bracket 30; at least one alignment bracket 40; "A" frame extrusions 90, "B" frame extrusions 97, and "C" frame extrusions 100; "B" battens 80*b* and "C" battens 80*c*; and assorted fabrications and fasteners that provide the carrier for the light translucent panels 60 used in various applications. As shown in FIG. 2, the system 10 requires a substrate upon which to build, such as frame stud FS, drywall DW, or the like. The plenum, a reflective surface/reflective coated surface, such as, e.g., reflective panel 20 is mounted to the drywall DW.

Figure 3:
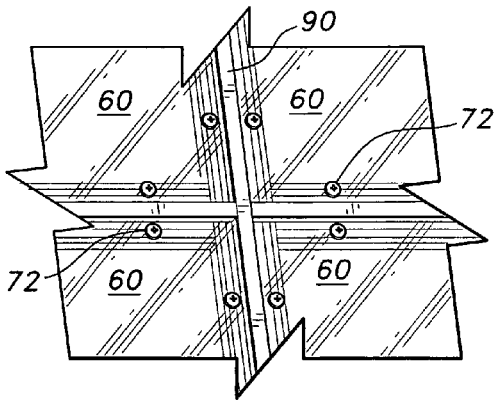
FIG. 3 is a top, perspective view of an "A" type joint assembly of a luminous wall system according to the present invention.
Figure 4:
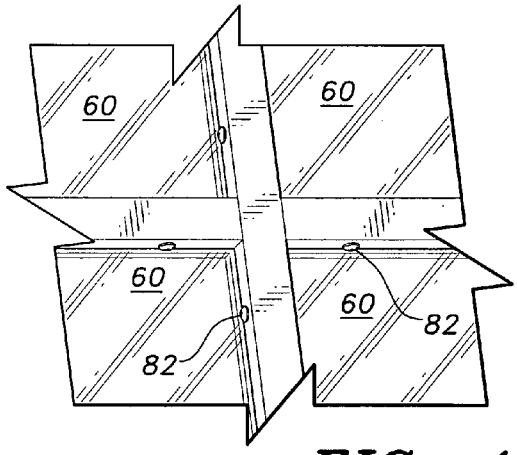
FIG. 4 is a top, perspective view of a "B" batten extrusion assembly of a luminous wall system according to the present invention.
Figure 5:
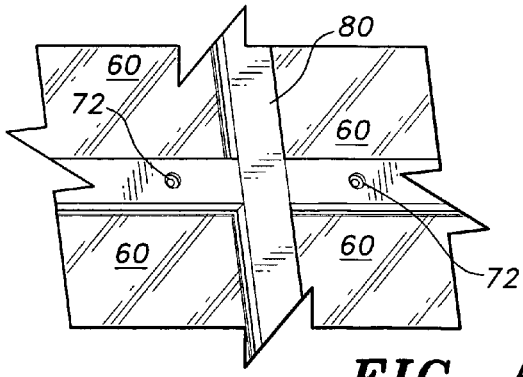
FIG. 5 is a top, perspective view of a "C" batten extrusion assembly of a luminous wall system according to the present invention.

The compression bracket 30 is mounted to the substrate, which may include reflective panel 20, dry wall DW, or the like, with wood screws WS or other fasteners in order to provide a stand-off anchor point for attachment of a vertical run of frame extrusion, such as frame rail 90. As shown in FIGS. 3-5, an "A" assembly comprises panels 60 joined to an orthogonal "A" rail configuration using fasteners 72. A "B" assembly comprises panels 60 joined to an orthogonal "B" rail configuration using fasteners 82. A "C" assembly comprises panels 60 joined to an orthogonal "C" rail configuration using fasteners 72.

It should be noted that for all joints between translucent light panels 60 and their respective extrusions as discussed herein, the drawings show an attachment with no spacing (air gap). However, the present invention contemplates that an expansion space of up to approximately 1/32" may be provided due to environmental factors, such as thermal extremes, and due to the choice of materials used.

Figure 7:
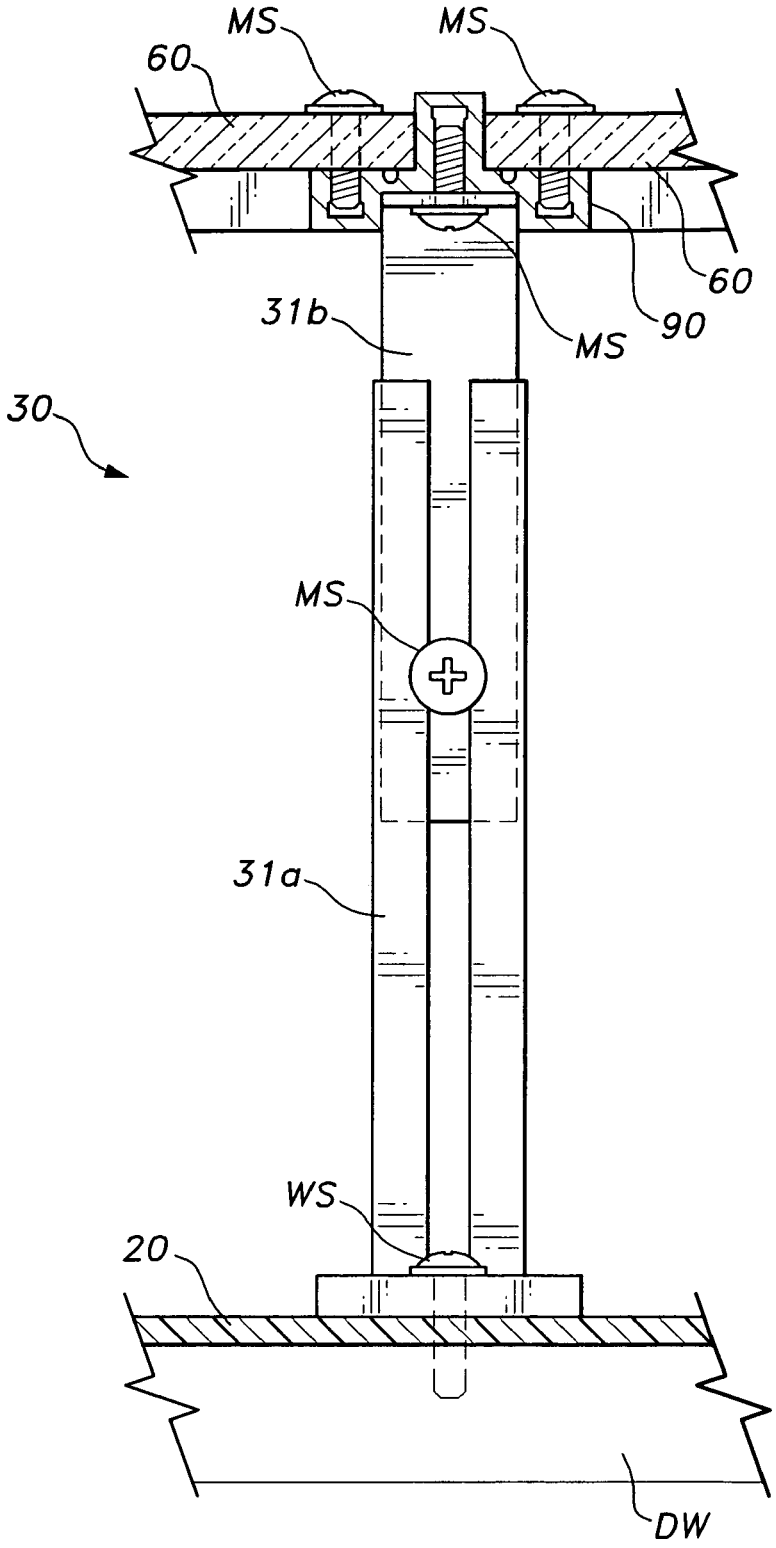
FIG. 7 is a top section view of a panel with "A" rail frame connection to compression bracket of a luminous wall system according to the present invention.

As shown in FIGS. 2 and 7, compression bracket 30 is comprised of an elongated, rectangular-shaped tubular collar 31*a* through which a corresponding L shaped sleeve 31*b* may fit. The collar 31*a* is slotted in its underside to permit screw adjustment of a longitudinal positioning of the sleeve 31*b* by means of machine screw MS.

A lighting fixture, such as lighting fixture 24, is attached to the reflective plenum 20 and can have either a vertical or a horizontal orientation. The lighting fixture 24 has an exposed periphery that allows for greater dispersion of light behind the translucent panels 60. The light fixture 24 has an elongated, triangular prism-shaped baffle 25 disposed between two parallel, elongated bulbs. The sides of the baffle 25 are made from a reflective surface so that light emanating from light bulbs 23 is directed both forward and laterally to provide even distribution of light across the decorative translucent panels 60.

Thus, the novel structure of light fixture 24 allows for improved energy efficiency by allowing wider "on center" spacing layout of multiple light fixtures 24 to thereby reduce the number of light fixtures 24 required to evenly illuminate the translucent panels 60. The light fixture 24 may be configured to apply illumination from any appropriate light source, e.g., fluorescent lamps 23, light emitting diodes (LEDs), etc.

The sleeve 31*b* of the compression bracket 30 is adjusted to provide stand-off clearance of the frame extrusions away from lighting fixture 24 or other devices that may be mounted on the plenum 20. A base of the L shaped sleeve 31*b* extends perpendicular to longitudinal run of the sleeve 31*a* and has a through-bore, through which a screw can be used to fasten the vertical frame extrusion, such as "A" rail 90, to the compression bracket 30.

Figure 6:
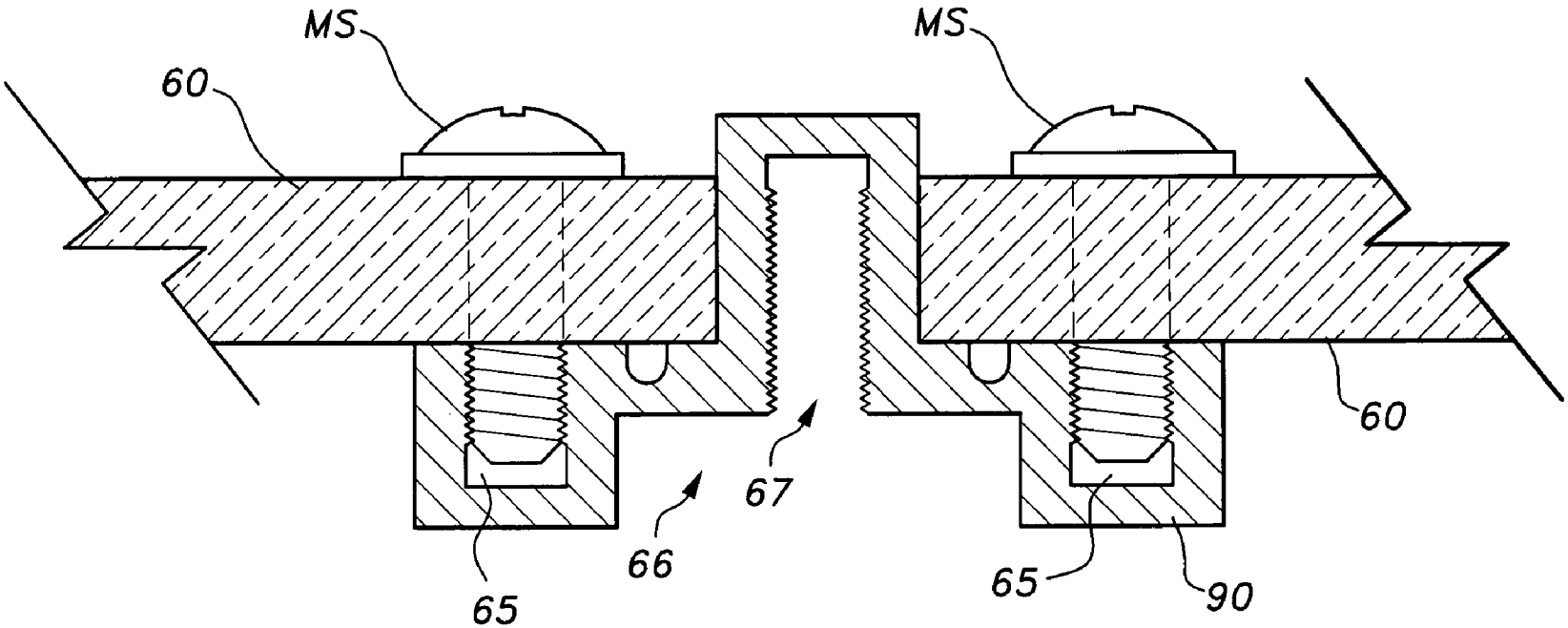
FIG. 6 is a section view of a panel and "A" rail frame connection of a luminous wall system according to the present invention.
Figure 18:
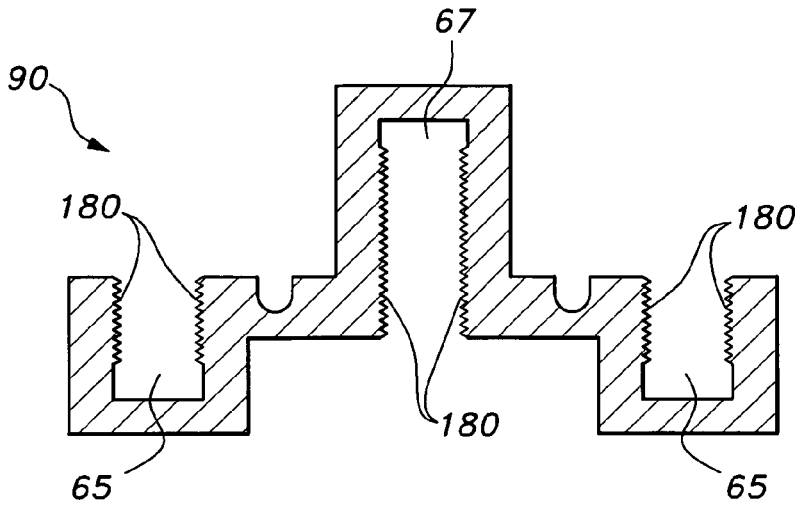
FIG. 18 is a detailed top section view of an "A" rail frame extrusion of a luminous wall system according to the present invention.

As shown in FIGS. 2 and 6, the "A" rail 90 is an elongated extrusion that comprises two outside channels 65 having channel openings facing the same direction, the two outside channels 65 bounding an alignment channel 66 that in turn bounds a central channel 67. The alignment and central channels 66 and 67 have their openings facing in an opposing direction to the outside channel openings, and are disposed in a symmetrical manner with respect to the outside channels 65. As shown in FIGS. 3 and 18, sidewalls of the outside channels 65, and sidewalls of the central channel 67 have threads or serrations 180 to accommodate threaded fasteners, such as face fastening machine screws 72, wherever they may be inserted in the channels.

Figure 24:
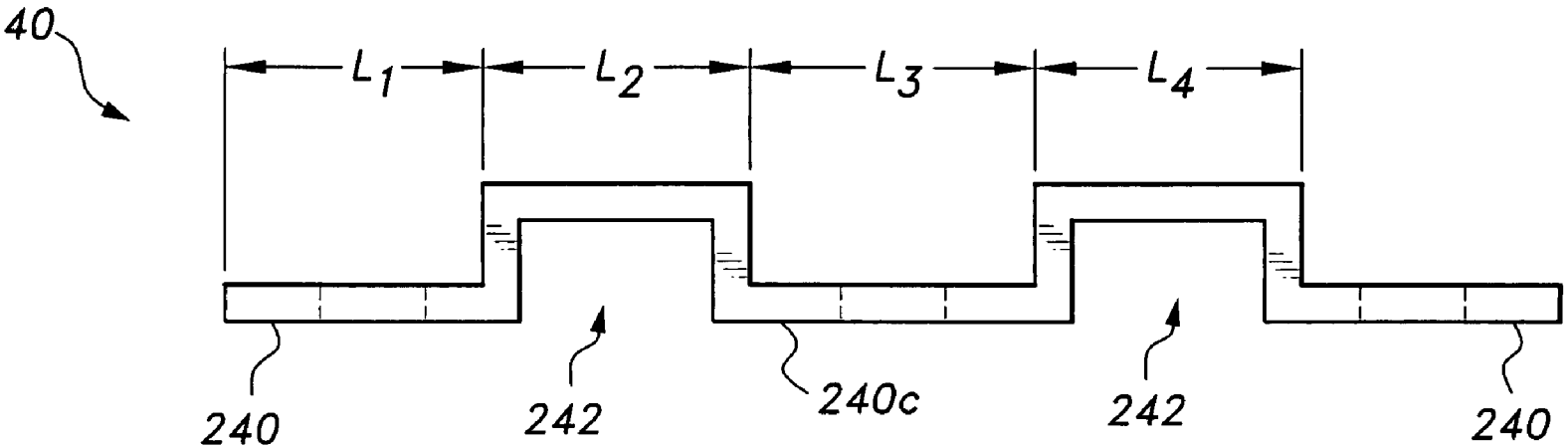
FIG. 24 is a detailed front edge view of the alignment bracket of a luminous wall system according to the present invention.

Referring to FIGS. 2 and 24, at least one alignment bracket 40 having three co-planar surfaces 240 with through-bores, the three co-planar surfaces 240 being separated by alignment bracket channels 242, is provided to fasten and align opposing horizontal sections of the frame extrusion to an adjoining vertical section of the frame extrusion. For example, as shown in FIG. 2, the central channel of horizontal rail 90 extends laterally beyond its outside channels to create a bight on each end of the rail that can fit into an adjoining vertically disposed rail 90. Thus, using threaded fasteners, opposing planar surface ends 240 of the alignment bracket 40 can be attached over the central channels 67 of corresponding opposing lateral extrusions for alignment so that the lateral extrusions are in adjacent and orthogonal relationship to the vertical extrusion.

A central planar surface 240*c* of the alignment bracket 40 is aligned over the central channel of the vertical extrusion and similarly fastened, using threaded fasteners, thus vertically aligning the horizontally extending extrusions. Adjacent outside channels 65 of the vertical and horizontal frame extrusion sections provide adjustable attachment points for decorative panel 60, shown as a translucent panel 60, to be securely attached to the frame extrusions using threaded fasteners, such as face fastening machines screws 72.

Figure 8:
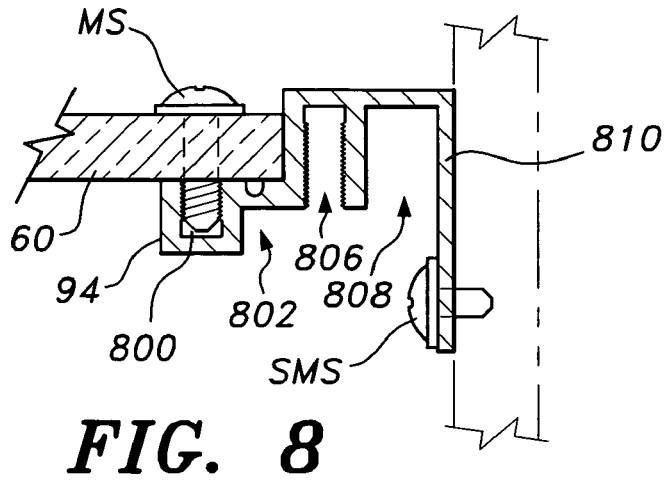
FIG. 8 is a top section view of an "A" edge panel connection of a luminous wall system according to the present invention.
Figure 19:
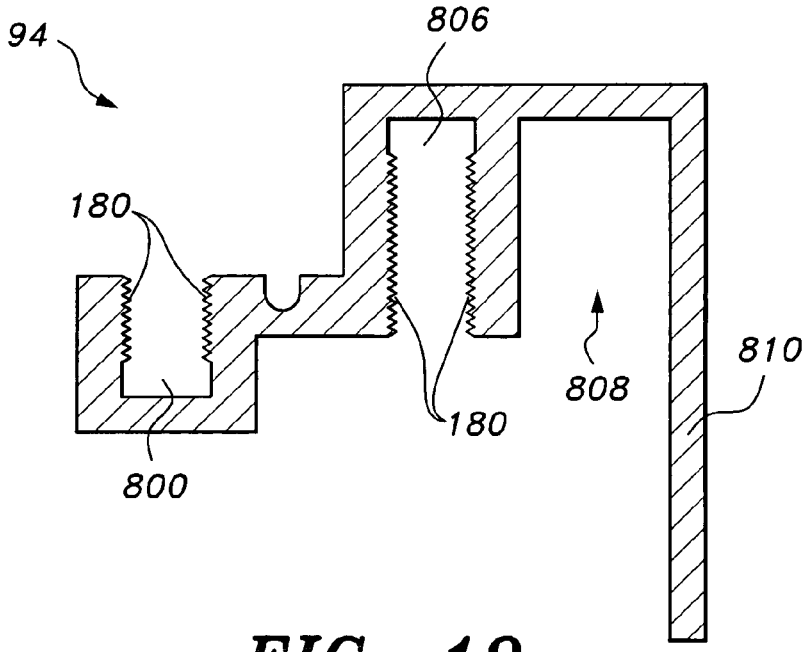
FIG. 19 is a detailed top section view of an "A" rail edge frame extrusion of a luminous wall system according to the present invention.

As shown in FIGS. 8 and 19, in order to connect a decorative panel, such as translucent panel 60, to a wall edge without using battens, an "A" type edge extrusion 94 having a wall-connecting sidewall 810, is provided. Additionally, the edge extrusion 94 has an outside edge extrusion channel 800 for attaching the decorative panel 60 using a machine screw MS. Also formed by this edge extrusion 94 are inside V channel 802, inside U channel 806, and inside L channel 808.

Figure 9:
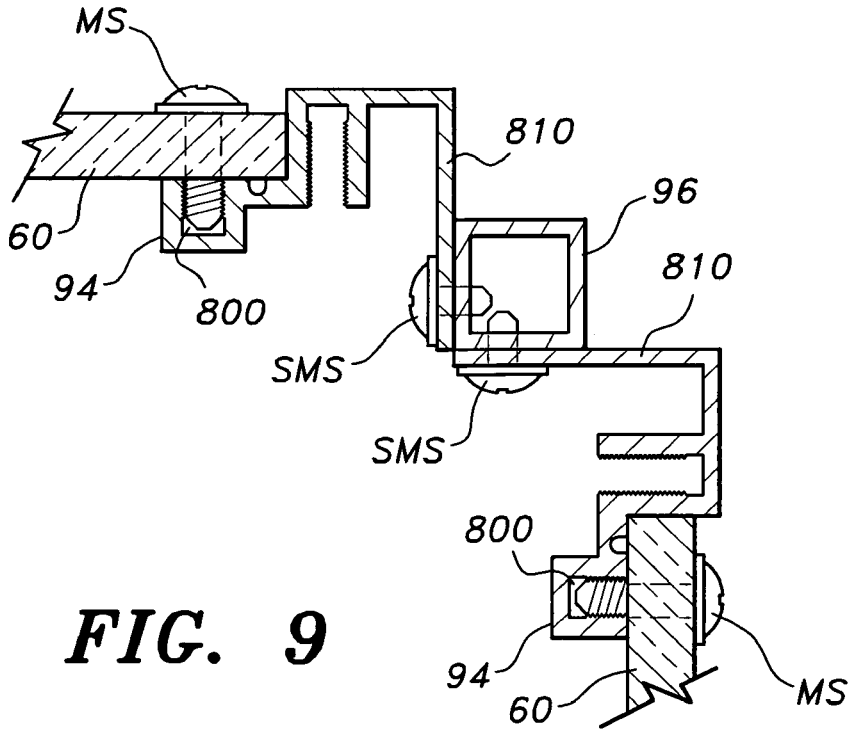
FIG. 9 is a top section view of a compound "A" edge panel connection of a luminous wall system according to the present invention.

As shown in FIG. 9, an orthogonal corner configuration of panels 60 may comprise two edge extrusions 94 connected to a rectangular tube member 96 using sheet metal screws SMS.

Figure 10:
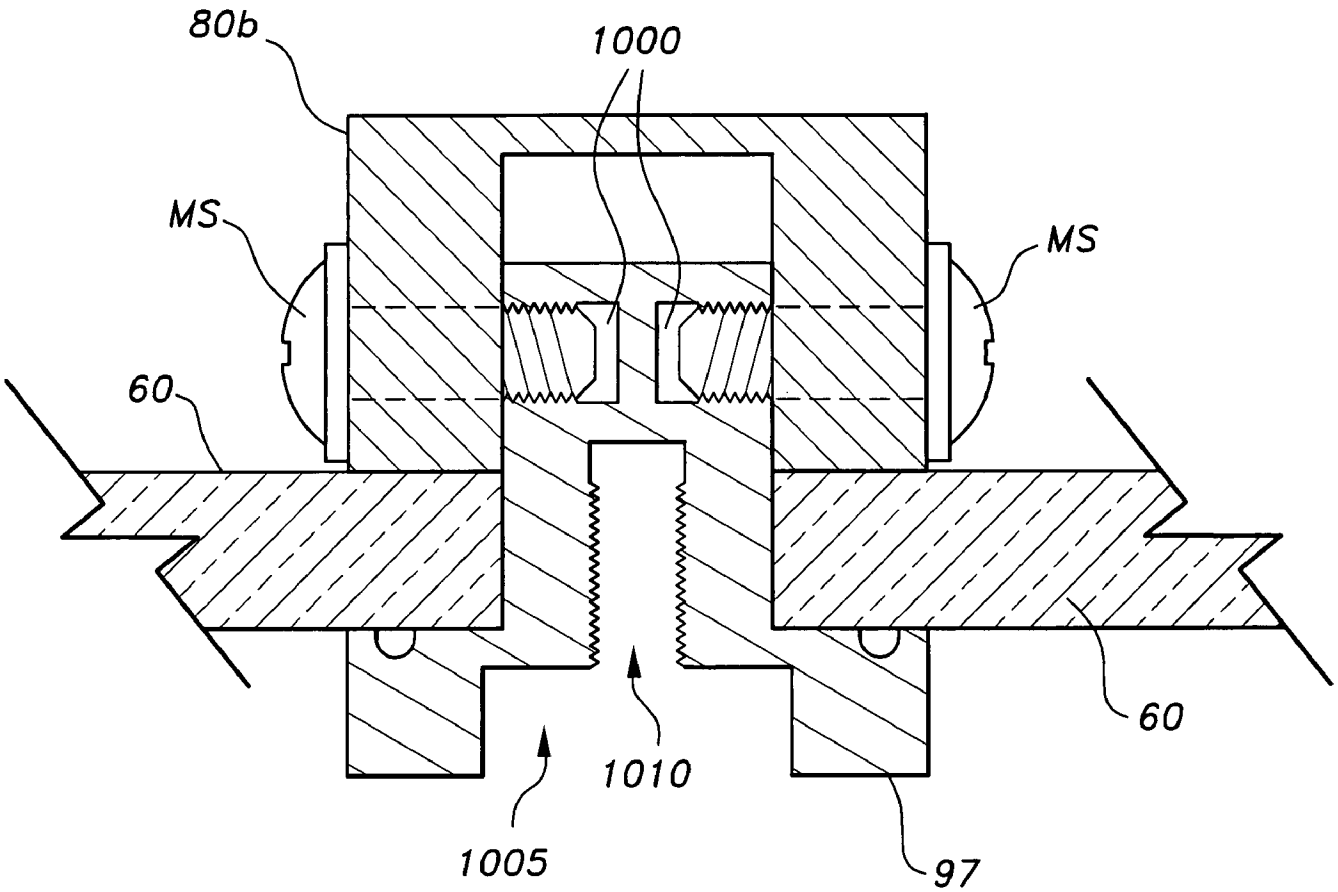
FIG. 10 is a top section view of a "B" batten, panel and frame connection of a luminous wall system according to the present invention.
Figure 11:
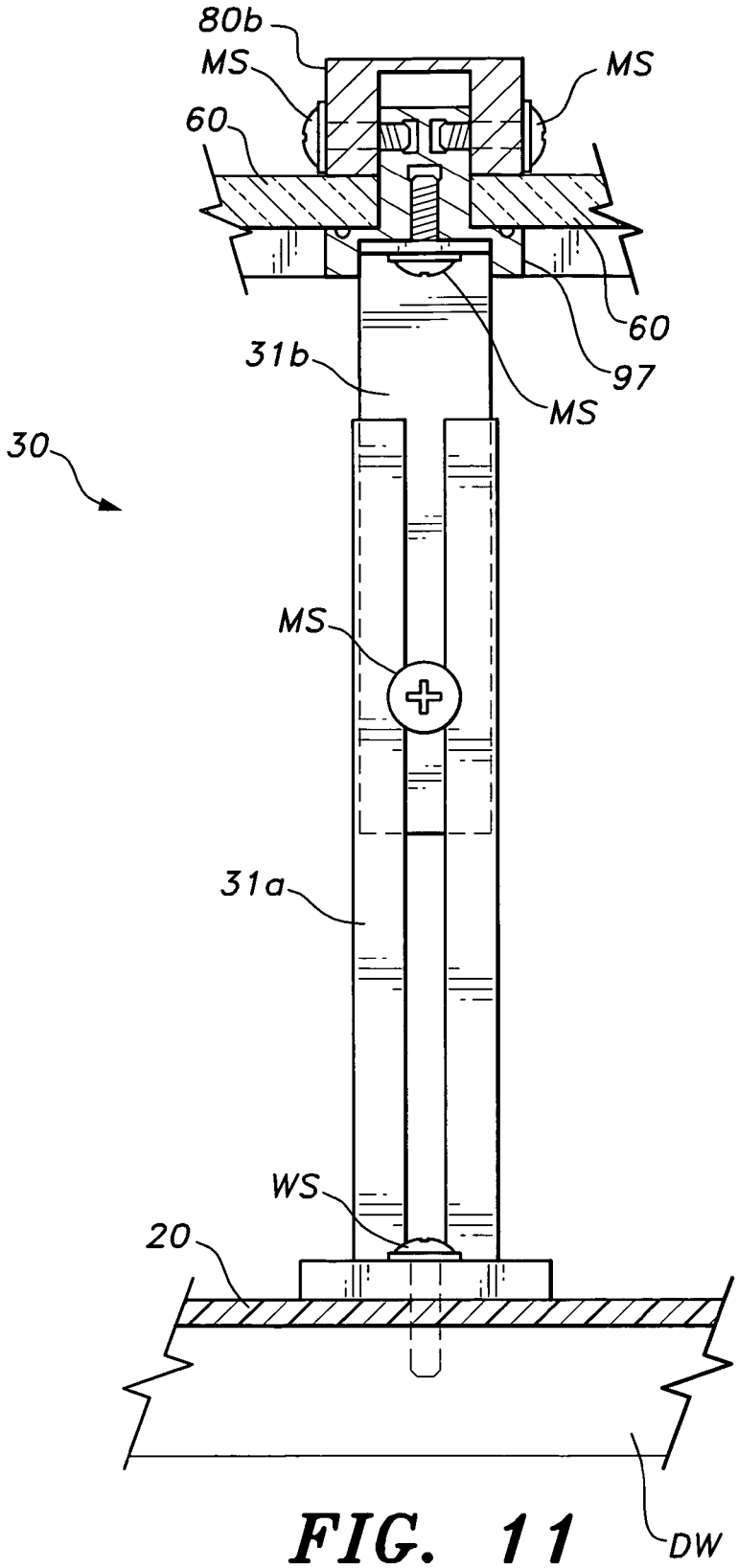
FIG. 11 is a top section view of a "B" batten, panel, and frame extrusion connected to a compression bracket of a luminous wall system according to the present invention.
Figure 20:
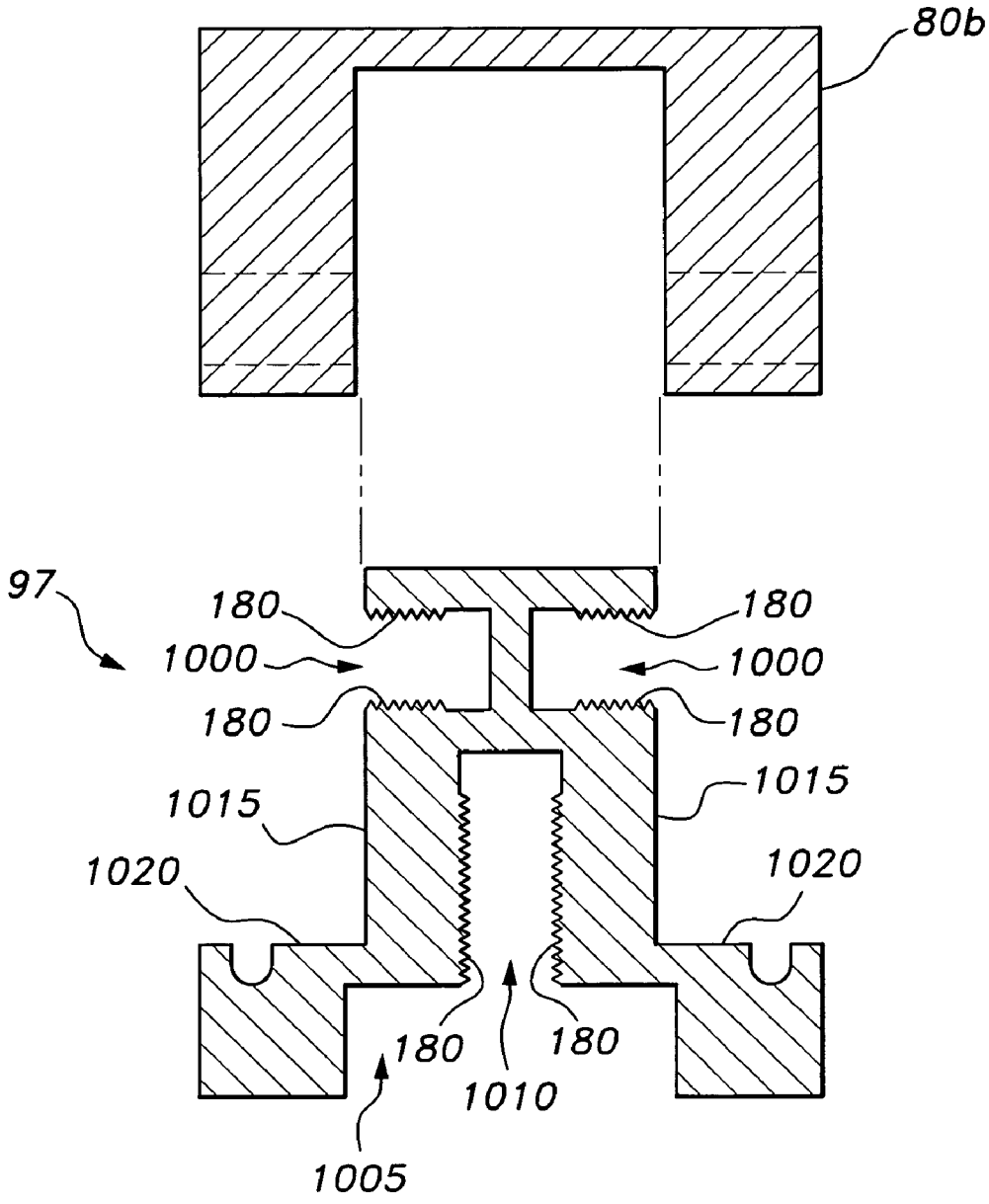
FIG. 20 is a detailed top section view of a "B" rail frame extrusion of a luminous wall system according to the present invention.

As shown in FIGS. 10 and 20, a decorative panel, such as translucent panel 60, may be joined to the wall system 10 using a "B" type batten 80*b* and a "B" type frame extrusion 97. Frame extrusion 97 is comprised of two opposing lateral channels 1000 having threads or serrations 180, as well as a longitudinal alignment channel 1005 that bounds a longitudinal central channel 1010. The batten extrusion forms longitudinal sidewalls 1015 and lateral floor surfaces 1020. As shown in FIG. 11, the rail frame extrusion 97 can be attached to the compression bracket by means of a fastener, such as machine screw MS, inserted into the longitudinal central channel 1010.

Figure 12:
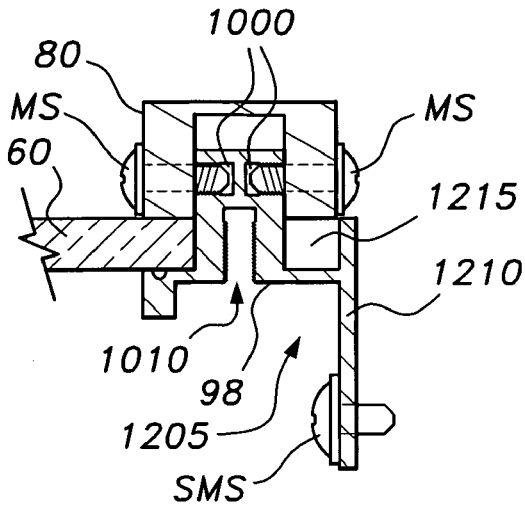
FIG. 12 is a top section view of a "B" edge panel connection of a luminous wall system according to the present invention.
Figure 21:
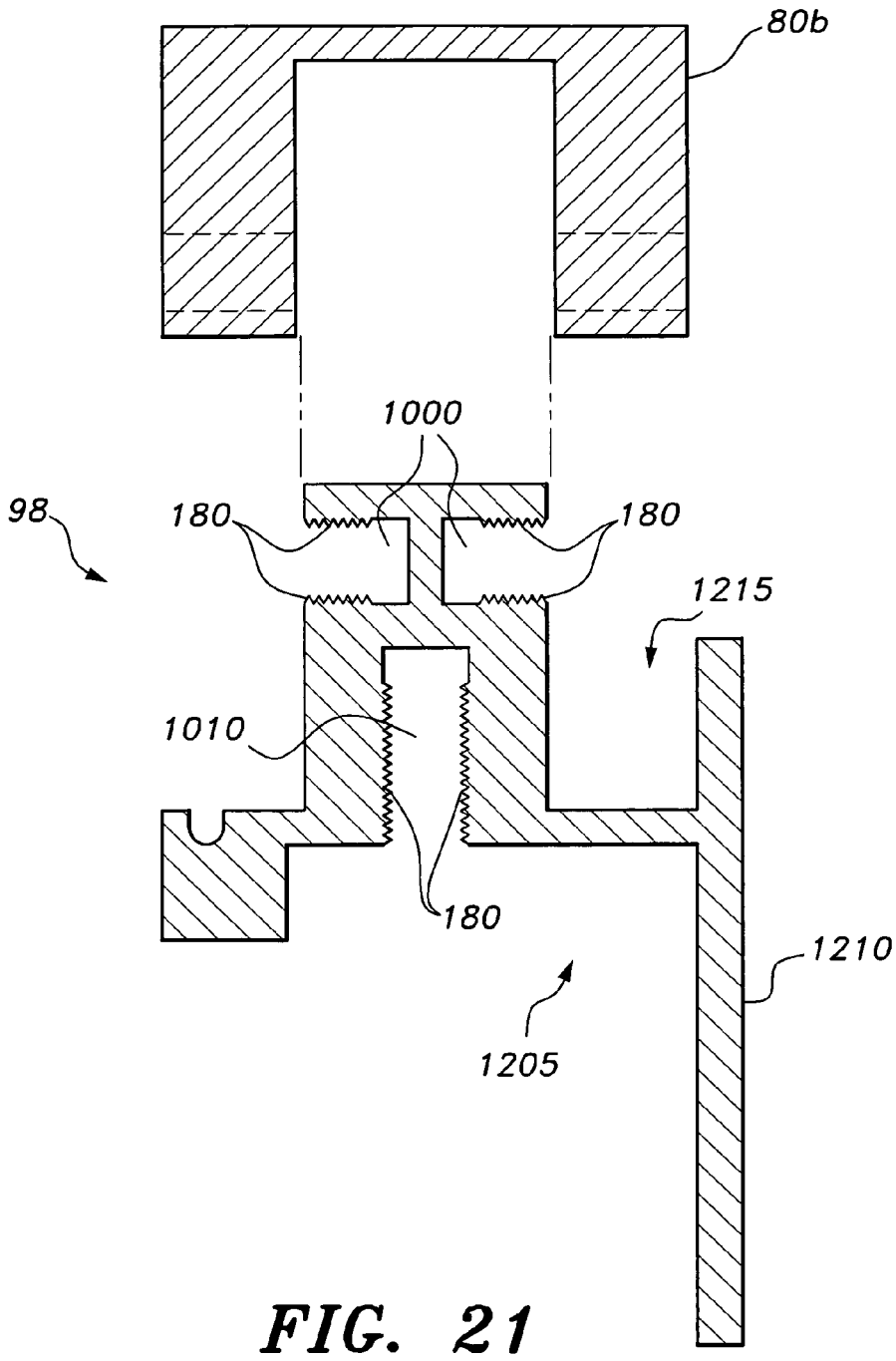
FIG. 21 is a detailed top section view of a "B" rail edge frame extrusion of a luminous wall system according to the present invention.

As shown in FIGS. 12 and 21, the "B" edge frame extrusion 98 is comprised of two opposing lateral channels 1000 having threads or serrations 180. Additionally, the "B" edge frame extrusion 98 has a "B" wall connecting sidewall 1210 that creates an outwardly directed U-channel 1215. Channel 1205 is the inwardly directed L channel, which bounds longitudinal central channel 1010.

Figure 13:
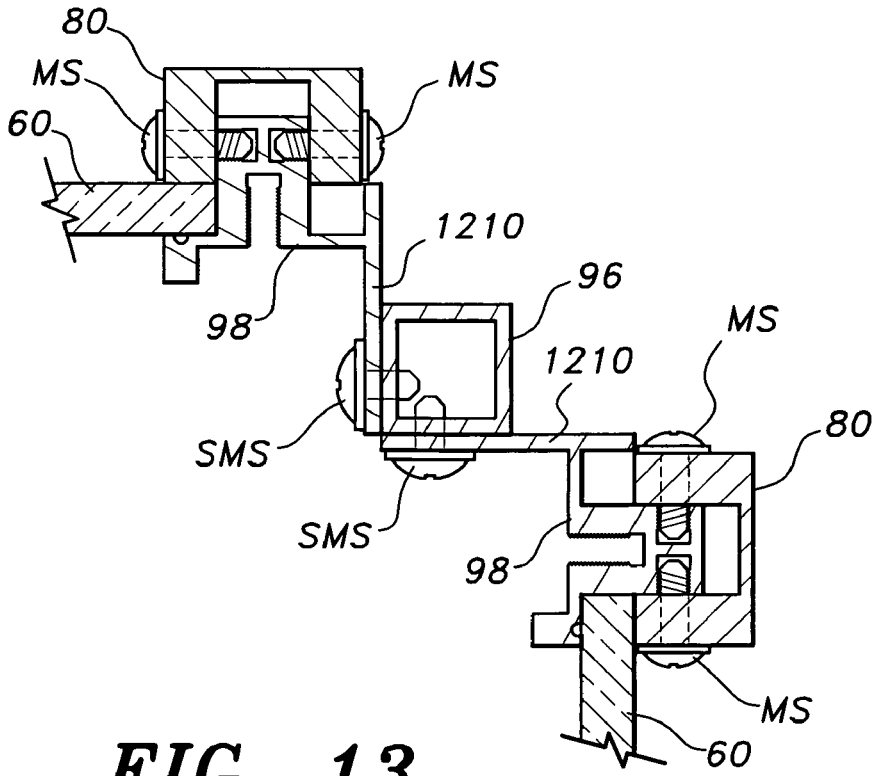
FIG. 13 is a top section view of a compound "B" edge panel connection of a luminous wall system according to the present invention.

As shown in FIG. 13, an outside corner can be created using two "B" edge extrusions 98 connected to adjacent faces of square tube 96.

Figure 14:
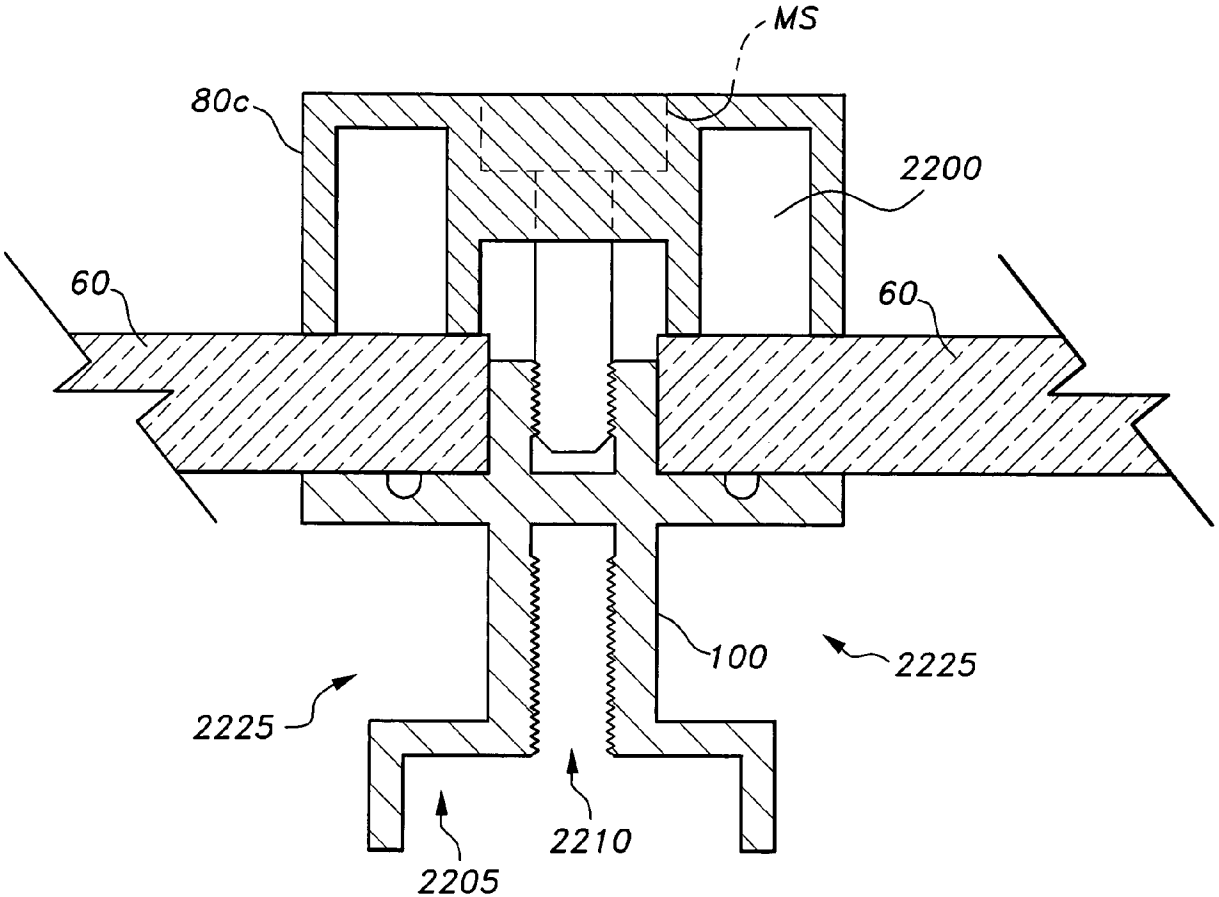
FIG. 14 is a top section view of a "C" edge panel connection of a luminous wall system according to the present invention.
Figure 15:
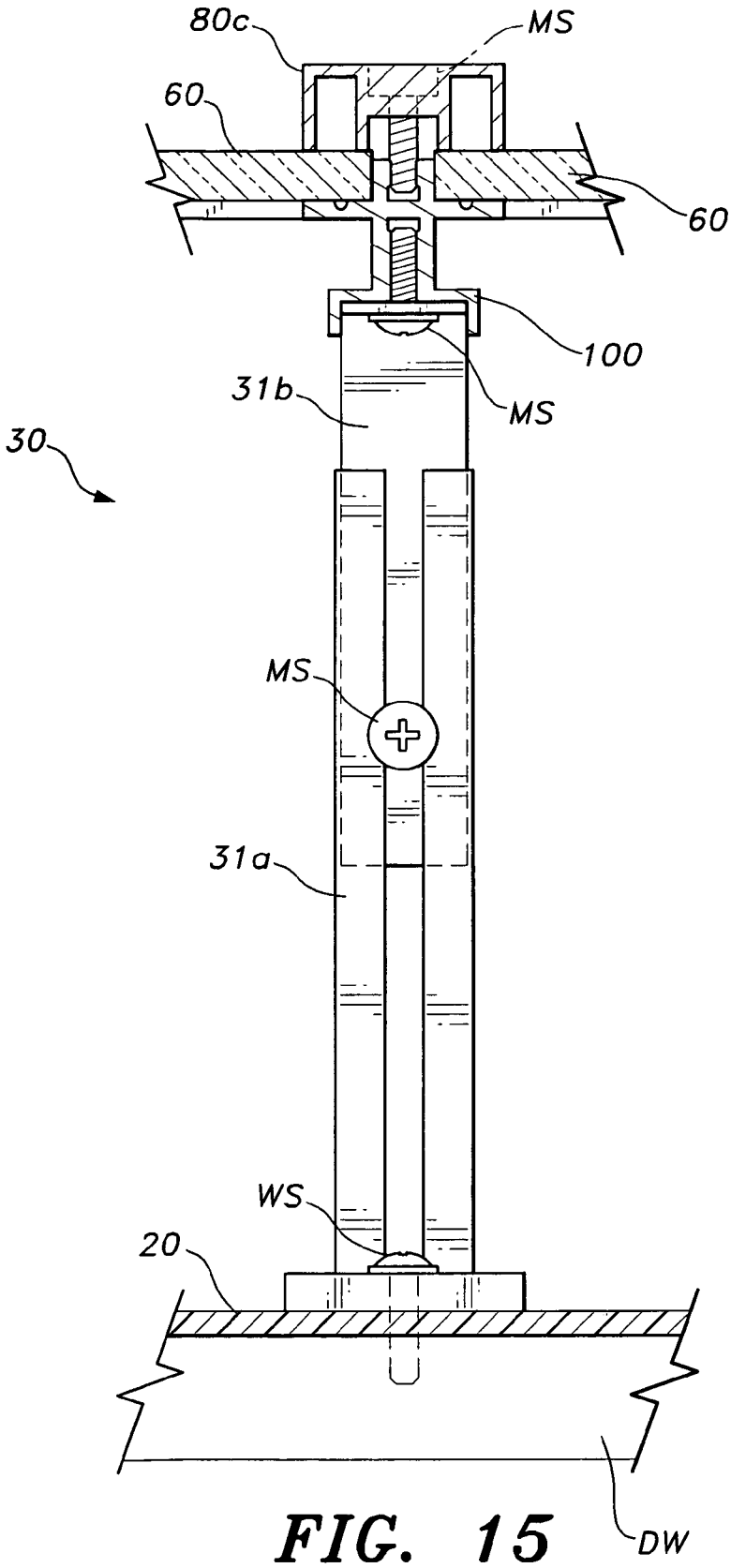
FIG. 15 is a top section view of a "C" batten, panel, and frame extrusion connected to a compression bracket of a luminous wall system according to the present invention.
Figure 22:
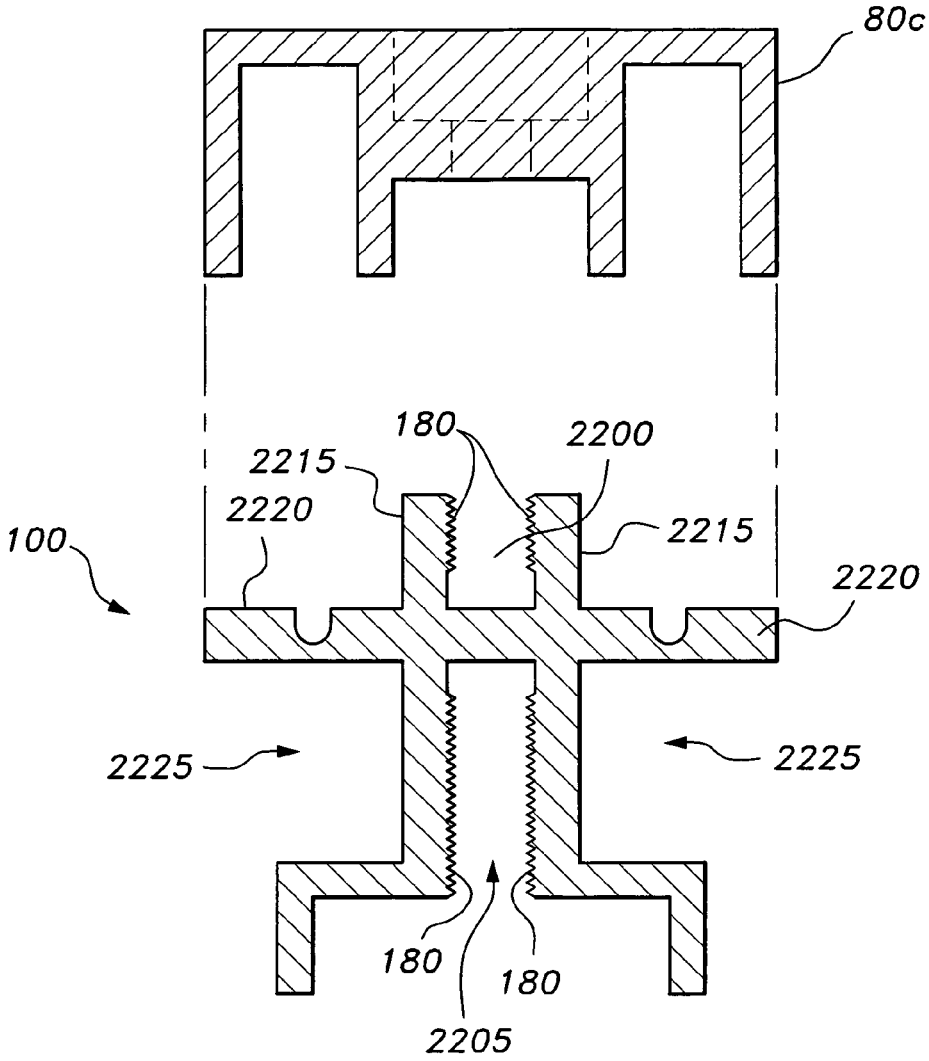
FIG. 22 is a detailed top section view of a "C" rail frame extrusion of a luminous wall system according to the present invention.

As shown in FIGS. 14 and 22, a decorative panel, such as translucent panel 60, may be joined to the wall system 10 using a "C" type batten 80*c* and a "C" type frame extrusion 100. Frame extrusion 100 is comprised of an outside longitudinal central channel 2200 having threads or serrations 180 disposed opposite an inside longitudinal central channel 2210. The formation of longitudinal central channels 2200 and 2210 creates sidewalls 2215, floor surfaces 2220, standoff channels 2225, and "C" extrusion longitudinal alignment channel 2205, which bounds the central channel 2210. As shown in FIG. 15, a "C" type frame extrusion 100 can be attached to the compression bracket by means of a fastener, such as machine screw MS, inserted into the "C" frame longitudinal central channel 2210.

Figure 16:
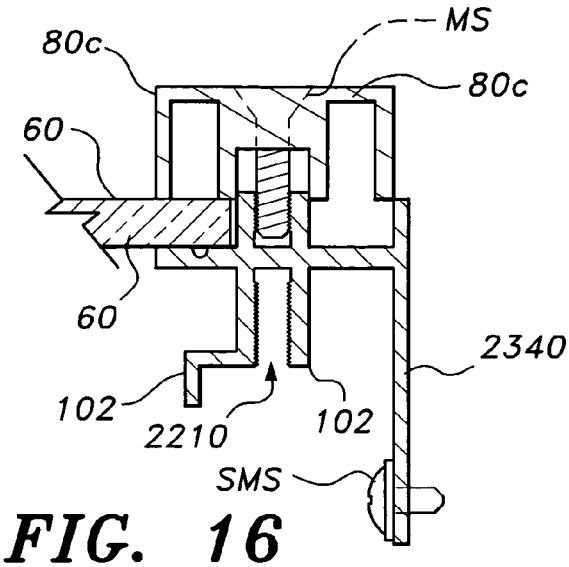
FIG. 16 is a top section view of a "C" batten, panel and "C" edge frame extrusion connection of a luminous wall system, according to the present invention.
Figure 23:
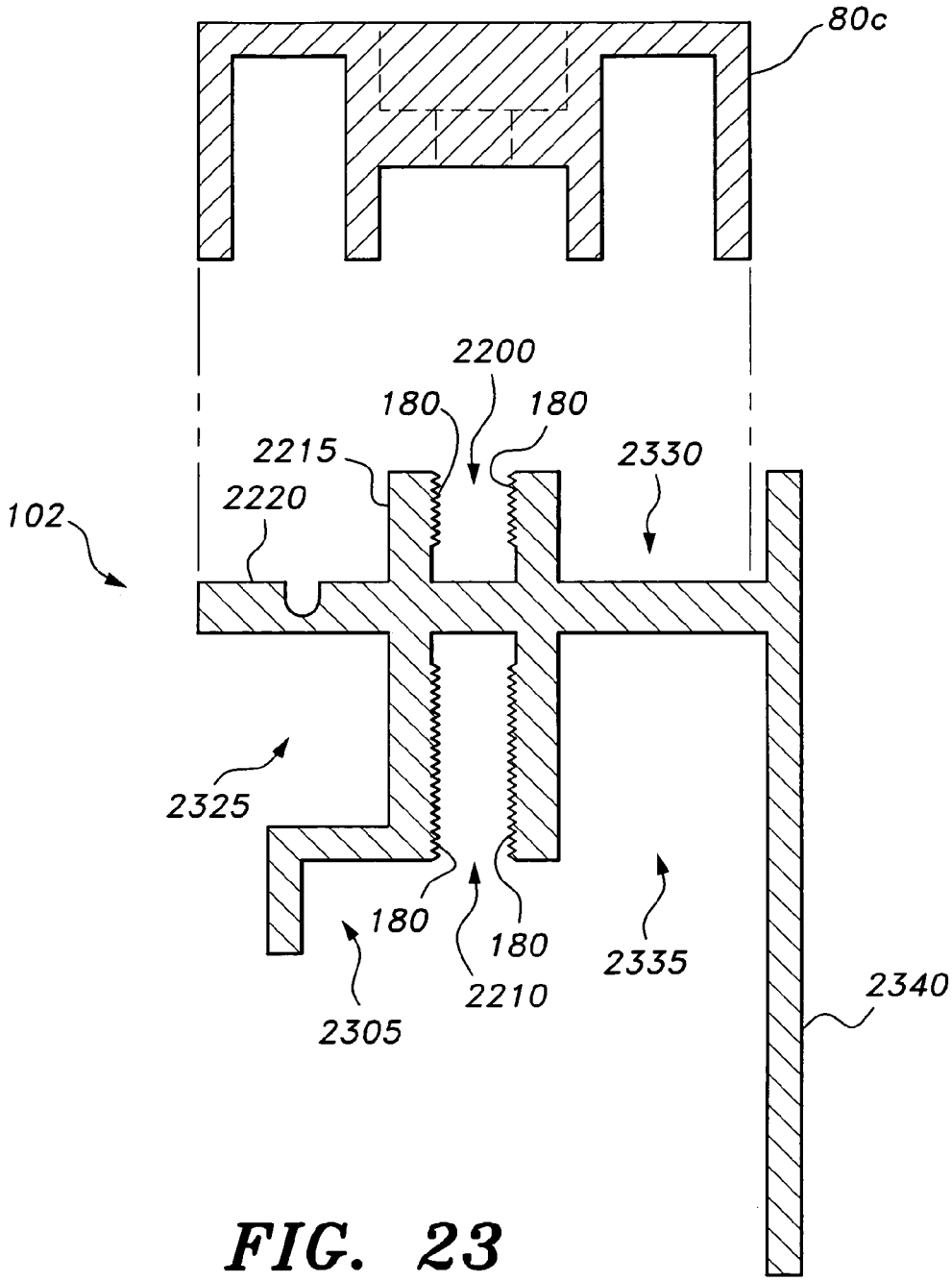
FIG. 23 is a detailed top section view of a "C" rail edge frame extrusion of a luminous wall system according to the present invention.

As shown in FIGS. 16 and 23, a "C" edge frame extrusion 102 is provided and comprises an outside longitudinal central channel 2200 having threads or serrations 180, the outside longitudinal central channel 2200 being disposed opposite an inside longitudinal central channel 2210. In addition to formation of longitudinal central channel 2200, an outside L-channel having floor surface 2220 and sidewall 2215 adjacent to the central channel 2200 is created. On an opposing side of the central channel 2200 is a U-channel 2330. Additionally, a "C" wall connecting sidewall 2340 creates an inwardly directed L-channel 2335. On an opposite side of the inside central channel 2210 are truncated U-channel 2325 and V-channel 2305.

Figure 17:
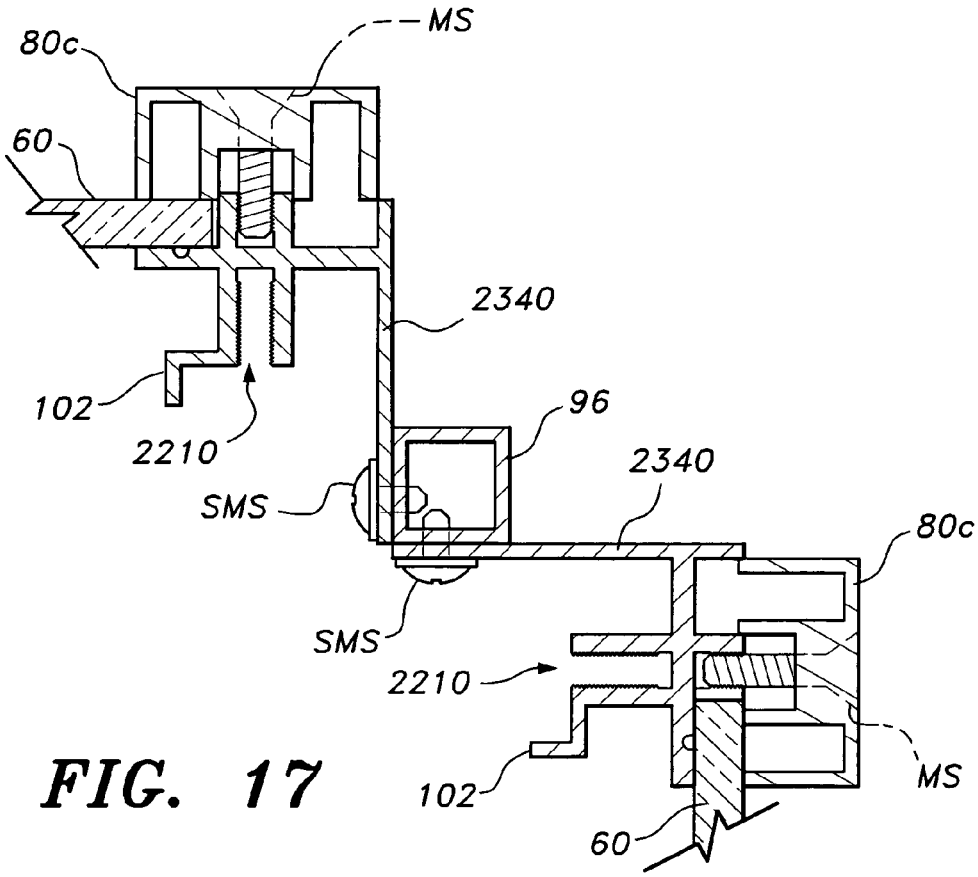
FIG. 17 is a top section view of a compound outside corner "C" edge panel connection of a luminous wall system according to the present invention.

As shown in FIG. 17, an outside corner can be created using two "C" edge extrusions 102 connected to adjacent faces of square tube 96.

The various extrusion types are provided so that specific assembled configurations of the aforementioned frame components are limited only by the geometric and aesthetic requirements of a particular application.

It is to be understood that the present invention is not limited to the embodiment described above, but encompasses any and all embodiments within the scope of the following claims.

We claim:

1. A luminous wall system, comprising:

a light reflective material adapted for mounting on a support wall;

a light source adapted for mounting on the support wall;

at least one stand-off bracket adapted for mounting in vertical alignment on the support wall, wherein the stand-off bracket has a collar and sleeve configuration, the sleeve being adjustable to set a desired standoff distance of the luminous wall system from the support wall;

at least one first rail and at least one second rail, the at least one first rail having a vertically adjustable attachment to the stand-off bracket so that the first rail extends vertically in front of the support wall, the at least one second rail being capable of attachment to the at least one first rail in an adjoining orthogonal relationship; and at least one translucent panel capable of being attached to the adjoining first and second rails;

whereby when the light source emits light, the luminous wall transmits the light in front of the wall in an aesthetically pleasing manner.

2. The luminous wall system according to claim 1, wherein the light reflective material comprises light reflective panels.

3. The luminous wall system according to claim 1, wherein the light source comprises at least one electrical lighting fixture.

4. The luminous wall system according to claim 1, wherein the stand-off bracket sleeve comprises an L-shaped member having a short leg adapted for being vertically aligned and having a through-bore for attachment to the first rail.

5. A luminous wall system, comprising:

a light reflective material adapted for mounting on a support wall;

a light source adapted for mounting on the support wall;

at least one stand-off bracket adapted for mounting in vertical alignment on the support wall;

at least one first rail and at least one second rail, the at least one first rail having a vertically adjustable attachment to the stand-off bracket so that the first rail extends vertically in front of the support wall, the at least one second rail being capable of attachment to the at least one first rail in an adjoining orthogonal relationship, wherein the first and second rails are extrusion members, each of the extrusion members includes two outside channels defining channel openings facing the same direction; the two outside channels bounding an alignment channel, the alignment channel bounding a central channel, the alignment and central channels having channel openings facing in an opposing direction to the outside channel openings, the alignment and central channels being disposed in a symmetrical manner with respect to the outside channels; and at least one translucent panel capable of being attached to the adjoining first and second rails;

whereby when the light source emits light, the luminous wall transmits the light in front of the wall in an aesthetically pleasing manner.

6. The luminous wall system according to claim 5, wherein the outside channels and the central channel have sidewalls having threads defined therein to accommodate threaded fasteners at any desired location along the length of the channels.

7. The luminous wall system according to claim 5, wherein the central channel of the second rail extends laterally beyond the outside channels of the second rail, forming a bight on each end of the second rail for forming a joint with an adjacent vertically disposed first rail.

8. The luminous wall system according to claim 5, further comprising an alignment bracket having three co-planar fitting members for fastening to the central channels of opposing lateral rail members and to a central channel of the adjoining vertical rail member.

9. The luminous wall system according to claim 5, wherein the at least one translucent panel is fastened to the outside channels of the adjoining vertical and horizontal rails.

10. The luminous wall system according to claim 5, further comprising: an edge extrusion member having an outside edge extrusion channel for attaching the translucent panel, and having a wall-connecting sidewall for attachment to a supporting wall.

11. The luminous wall system according to claim 10, further comprising a rectangular tube member for connecting two of the edge extrusion members to form a corner having orthogonally disposed decorative panels.

12. The luminous wall system according to claim 5, further comprising:

a batten extrusion having two opposing lateral channels, the opposing lateral channels being threaded, a longitudinal alignment channel, and a longitudinal central channel, the batten extrusion forming longitudinal sidewalls and lateral floor surfaces, an edge of the translucent panels fitting onto the lateral floor surfaces, the batten extrusion being fastened to the stand-off bracket by a threaded fastener fastened through the longitudinal central channel; and a batten placed over the edge of the translucent panel and fastened to the batten extrusion to secure the translucent panel.

13. The luminous wall system according to claim 1, wherein the light source mounting on the support wall is in a vertical orientation.

14. The luminous wall system according to claim 1, wherein the light source mounting on the support wall is in a horizontal orientation.

15. A luminous wall system, comprising:

a light reflective material adapted for mounting on a support wall;

a light source adapted for mounting on the support wall, wherein said light source comprises:

a first elongated light source and a second elongated light source;

an elongated baffle having opposing reflective surfaces, the first and second light sources being disposed on opposite sides of the baffle adjacent the reflective surfaces, the reflective surfaces being configured to reflect light emitted from the light sources both forward and laterally in order to provide uniform lighting behind the translucent panel;

at least one stand-off bracket adapted for mounting in vertical alignment on the support wall;

at least one first rail and at least one second rail, the at least one first rail having a vertically adjustable attachment to the stand-off bracket so that the first rail extends vertically in front of the support wall, the at least one second rail being capable of attachment to the at least one first rail in an adjoining orthogonal relationship; and at least one translucent panel capable of being attached to the adjoining first and second rails;

whereby when the light source emits light, the luminous wall transmits the light in front of the wall in an aesthetically pleasing manner.

16. The luminous wall system according to claim 15, wherein said first and second light sources comprise fluorescent lamps.

17. The luminous wall system according to claim 15, wherein said first and second light sources LEDs.

18. The luminous wall system according to claim 15, wherein said baffle comprises a triangular prism-shaped body.

* * * * *